US006841205B1

(12) United States Patent
Sismondi et al.

(10) Patent No.: US 6,841,205 B1
(45) Date of Patent: Jan. 11, 2005

(54) INK-JET PRINTING RECEIVING SHEET COMPRISING GELATIN AND A METAL SALT

(75) Inventors: Alain Dominique Sismondi, Nice (FR); Giuseppe Loviglio, Savana (IT); Marco Serafini, Ferrania (IT); Pierfiore Malfatto, Ferrania (IT); Diego Brignone, Rocchetta di Cairo (IT)

(73) Assignee: Ferrania, S.p.A., Savona (IT)

( * ) Notice: Subject to any disclaimer, the term of this patent is extended or adjusted under 35 U.S.C. 154(b) by 370 days.

(21) Appl. No.: 09/643,026

(22) Filed: Aug. 21, 2000

(30) Foreign Application Priority Data

Sep. 3, 1999 (IT) ..... SV99A0029

(51) Int. Cl.[7] ..... B41M 5/00
(52) U.S. Cl. ..... 428/32.27; 428/32.24
(58) Field of Search ..... 428/32.24, 32.27, 428/195, 478.2

(56) References Cited

U.S. PATENT DOCUMENTS

| | | | | |
|---|---|---|---|---|
| 4,554,181 A | | 11/1985 | Cousin et al. | 427/261 |
| 4,649,064 A | | 3/1987 | Jones | 427/256 |
| 4,740,420 A | | 4/1988 | Akutsu et al. | 428/341 |
| 4,946,741 A | * | 8/1990 | Aono et al. | 428/336 |
| 5,320,897 A | * | 6/1994 | Kondo et al. | 428/195 |

FOREIGN PATENT DOCUMENTS

| | | |
|---|---|---|
| EP | 0705172 | 12/1998 |
| EP | 0928841 | 7/1999 |
| GB | 2147003 | 5/1985 |
| GB | 2301845 | 12/1996 |
| WO | 9528285 | 10/1995 |
| WO | 9906219 | 2/1999 |

OTHER PUBLICATIONS

Patent Abstracts of Japan, vol. 007, No. 193, Aug. 24, 1983.
Patent Abstracts of Japan, vol. 010, No. 096, Apr. 12, 1986.
Abstract for Japanese Patent JP59078885; Entitled: Ink Jet Recording Sheet; Inventors: Akutsu Hidekazu, Fujii Tadashi, Murakami Kakuji, Ariga Tamotsu; Filed Oct. 27, 1982, Published May 04, 1984.
Abstract for Japanese Patent JP59096988; Entitled: Recording Medium; Inventors; Akutsu Hidekazu, Fujii Tadashi, Murakami Kakuji, Ariga Tamotsu; Filed Nov. 26, 1982, Published Jun. 04, 1984.

* cited by examiner

*Primary Examiner*—Bruce H. Hess
(74) *Attorney, Agent, or Firm*—Mark A. Litman & Associates, P.A.

(57) ABSTRACT

The present invention refers to an ink jet receiving sheet having a surface pH value lower than 5.0 and comprising a support and at least a receiving layer containing a binder selected from the group consisting of gelatin and gelatin derivatives and at least a salt of a metal selected from the IIA and IIB groups of the periodic table of elements or complexes which comprise said metal salts.

The ink jet receiving sheet of the invention provides minimum post printed drop sweating after stressed ageing in the resulting image, still maintaining a good glossiness.

19 Claims, No Drawings

INK-JET PRINTING RECEIVING SHEET COMPRISING GELATIN AND A METAL SALT

FIELD OF THE INVENTION

The invention relates to an ink receptor for ink jet printers, and more particularly, to an ink receptor containing a combination of gelatin, as a binder, and salts of a metal selected from the IIA or IIB groups of the periodic table of elements or complexes which comprise said metal salts as additives to improve post printed drop sweating after stressed aging in the resulting image, still maintaining a good glossiness.

BACKGROUND OF THE INVENTION

Ink jet printing is becoming increasingly popular, particularly for so-called "desk-top publishing", because of its capability to produce small volumes of printed matter from digital input at high throughput speeds. Recent equipment developments have led to the introduction of multi-color ink jet printers that integrate colored graphics and text. To some extent, however, the applications of ink jet printing have been limited due to the demanding requirements the ink receptors must meet in order to provide high quality text and graphics.

It is desirable that receiving media for inkjet printing are capable of absorbing significant amounts of liquid to ensure that the surface of said receptors be dry and non tacky to the touch after printing; but it is also desirable to maintain durability of printing image.

In case of multicolor ink-jet receptors, the ink-receiving layer is often subjected to multiple print, one for each primary color (yellow, magenta and cyan). During the first or second print, the amount of organic compounds absorbed in the layer can be partially desorbed creating on the image surface a local organic compound concentration that are visible as drop. Where a yellow ink is absorbed by the ink receiving layer after cyan and magenta inks have been already absorbed therein, it is possible to have the formation of yellow colored drops in specific areas on the surface of the receiving layer, areas that have been saturated with cyan and magenta inks and that are no more able to properly absorb additional inks. This problem is generally known as post printed drop sweating.

PCT Patent Application 99-06,219 describes a composition useful for surface treating a substrate for ink jet printing comprising a salt of a divalent metal being soluble in an aqueous medium at about pH 7 to about pH 9, further comprising a carrier agent and a sizing agent. Indicia printed thereon will have improved print quality characteristics.

European Patent Application 928,841 discloses an ink/media combination, in which the ink comprises an aqueous medium, a colorant and an alginic acid salt selected from the group consisting of monovalent ion salts and organic amine salts and in which the media, preferably a textile, treated with a specific water soluble salt of a metal having a valence of at least 2 produce printed chromatic images with improved bleed characteristics and sharper edges.

U.S. Pat. No. 4,649,064 discloses a rapid-drying image-recording element adapted for water-based liquid ink marking, in devices such as pen plotters, ink jet printers and the like, comprising a support having thereon a hydrophilic ink-receiving layer which is cross-linked to a degree sufficient to render it non-blocking and waterfast while permitting it to rapidly absorb a water-based liquid ink. The element is utilized in combination with a water-based liquid ink that comprises a water-dispersible cross-linkable colorant/resin composition and the ink-receiving layer contains a cross-linking agent which cross-links the colorant/resin composition, thereby rendering the ink markings smear-resistant, abrasion-resistant and waterfast.

U.S. Pat. No. 4,554,181 describes an ink jet receiving sheet having a receiving surface which includes a combination of a water soluble polyvalent metal salt and a cationic polymer, said polymer having cationic groups which are available in the receiving surface for ionically interacting with an anionic dye and insolubilizing it. Good water fastness is obtained.

JP Patent Application 59-096,988 discloses a receiving material comprising a substrate coated with layer containing a pigment, a binder and a water-soluble salt of metal having valency of at least 2 as waterproofing agent. The pigment is, for example, $CaCO_3$, $BaSO_4$, $TiO_2$, and the like; the binder is, for example, oxidized starch, polyvinyl acetate latex, and the like. Decolorization or smearing of color on wetting is prevented. The water-soluble salt of metal makes color waterproof without changing the hue and improves color stability.

JP Patent Application 59-078,885 discloses an ink-jet receiving sheet having a degree of sizing of 20 seconds or less, a surface pH value between 5 and 10 and containing at least one halide, sulphate or nitrate of magnesium or calcium at a coverage of 0.1–15 g/m$^2$. The receiving sheet has a better water resistance but does not lower the colour tone of dye.

U.S. Pat. No. 4,740,420 discloses a receiving medium for ink-jet printing comprising a support material containing at least in the surface portion thereof a water-soluble metal salt with the ion valence of the metal being 2 to 4 and a cationic organic material selected from the group consisting of alkylamine salts, quaternary ammonium salts and polyamines to improve water resistance of the printed images.

EP Patent Application 705,172 describes a receiving sheet for ink jet printing comprising a support having coated thereon one or more layers receptive for aqueous inks, said receiving sheet being characterized in that the coating comprises at least one trivalent salt of a metal of the Group IIIb of the periodic table of elements to improve water resistance. The preferred metal used in the trivalent salt is lanthanum.

Thus, there is a need for improved ink receptors that have minimum post printed drop sweating after stressed ageing, still maintaining a good glossiness.

SUMMARY OF THE INVENTION

The ink jet receiving sheet of the invention has a surface pH value of less than 5.0 and comprises a support and at least a receiving layer containing a binder selected from the group consisting of gelatin and gelatin derivatives, and at least a salt of a metal selected from the IIA or IIB groups of the periodic table of elements or complexes which comprise said metal salts as additives to improve the post printed drop sweating after stressed ageing, still maintaining a good glossiness.

DETAILED DESCRIPTION OF THE INVENTION

A first essential element of the ink jet receiving sheet according to the present invention is the use, of gelatin or gelatin derivatives as binder component of the ink receiving layer(s).

Any gelatin made from animal collagen can be used, but gelatin made from pig skin, cow skin or bone collagen is preferable. The kind of gelatin is not specifically limited, but lime-processed gelatin, acid-processed gelatin, inactivated amino group gelatin (such as acetylated gelatin, phthaloylated gelatin, malenoylated gelatin, benzoylated gelatin, succinoylated gelatin, methyl urea gelatin, phenylcarbamoylated gelatin, and carboxy modified gelatin), or gelatin derivatives (for example, gelatin derivatives disclosed in JP Patents 384854/1962, 39-5514/1964, 40-12237/1965, 42-26345/1967 and 2-13595/1990, U.S. Pat. Nos. 2,525,753, 2,594,293, 2,614,928, 2,763,639, 3,118,766, 3,132,945, 3,186,846 and 3,312,553 and GB patents 861,414 and 103,189) can be used singly or in combination.

The gelatin binder ordinarily makes up from 30 to 90 weight % and preferably 50 to 80 weight % based on the solid content of the ink receiving layer compositions. Preferably, the ink receiving layers totally comprise a binder amount of from 1 to 20 g/m$^2$, and more preferably from 2 to 10 g/m$^2$.

The second essential element according to the present invention is the use in the ink receiving layer(s) of at least a salt of metal selected from the HA or IIB groups of the periodic table of elements or complexes which comprise salts of metal selected from the IIA or IIB groups of the periodic table of elements as additive to improve the post printed drop sweating after stressed ageing. Preferred bivalent metals that can be used in the present invention include magnesium, calcium, barium and zinc. The most useful salts include salts of mineral acids and salts of organic acids. Preferred types of salts which can be used include nitrates, sulfates, and chlorides. Preferred metal salts to be used in the present invention are magnesium sulfate, magnesium nitrate, calcium sulfate, calcium nitrate, zinc sulfate, zinc nitrate and barium chloride.

The proportions of the ingredients making up the coating compositions which form the ink-receiving layer can be widely varied to meet the requirements of the particular element involved. Typically, the resulting ink receiving layers totally comprise an amount of metal salts in the range from 0.05 to 2.0 g/m$^2$, preferably from 0.1 to 1.0 g/m$^2$. When preparing the ink jet receiving sheet by coating a plurality of ink receiving layers, the metal salts are added to the two ink receiving layers nearest to the support in an amount ranging from 0.025 to 1.0 g/m$^2$ for each layer.

The resulting ink receiving layers totally comprise a gelatin/metal salts ratio in the range from 2:1 to 200:1, preferably from 5:1 to 50:1.

The ink receiving layer(s) may also contain a glossiness improving agent represented by monosaccharides and/or oligosaccharides and/or polysaccharides having a recurring unit comprising five or six carbon atoms. Said saccharides can be hydrogenated or non-hydrogenated. Preferred recurring units include, for example, glucose, xylose, mannose, arabinose, galactose, sorbose, fructose, fucose, adonitol, arbitol, inositol, xylitol, dulcitol, iditol, lactitol, mannitol, sorbitol, and the like. The average molecular weight of said saccharides ranges from 1,000 to 500,000, preferably from 1,000 to 30,000.

Hydrogenated and non-hydrogenated saccharides useful in the present invention are commercially available, for example, under the trade designation POLYSORB™ or GLUCIDEX™, from Roquette, Lille, France. The preparation of hydrogenated and non-hydrogenated saccharides usually starts from natural products (like starch, agar, tragacanth gum, xanthan gum, guar gum, and the like) by means of enzymatic processes (to reduce the average molecular weight) and of reducing processes (to saturate the molecule, in case of hydrogenated saccharides).

The above-described glossiness improving agents ordinarily make up to 30 weight % and preferably up to 20 weight % based on the solid content of the ink receiving layer compositions. Preferably, the resulting ink receiving layers totally comprise a glossiness improving agent amount of from 0.1 to 5 g/m$^2$, preferably from 0.5 to 3 g/m$^2$.

The support used in the ink jet receiving sheet of the invention includes any conventional support for ink jet receiving sheet. A transparent or opaque support can be used according to the final use of the ink jet receiving sheet. Useful examples of transparent supports include films of polyester resins, cellulose acetate resins, acryl resins, polycarbonate resins, polyvinyl chloride resins, poly(vinylacetal) resins, polyether resins, polysulfonamide resins, polyamide resins, polyimide resins, cellophane or celluloid and a glass plate. The thickness of the transparent support is preferably from 10 to 200 $\mu$m. Useful examples of opaque supports include paper, coat paper, synthetic paper, resin-covered paper, and pigment-containing opaque films, but synthetic paper, a resin-covered paper or various films are preferable in view of glossiness or smoothness, and resin-covered paper or polyester film are preferable in view 93 of touchiness or luxuriousness.

The base paper constituting the resin-covered paper useful in the invention is not specifically limited, and any paper can be used, but a smooth paper used as a conventional photographic support is preferable. The pulp used for the preparation of the base paper, singly or in admixture, is constituted by natural pulp, reproduction pulp, chemical pulp such as hardwood bleached kraft pulp, softwood bleached kraft pulp, high yield pulps such as groundwood pulp or thermomechanical pulp, recycled pulps and non-wood pulps such as cotton pulp or synthetic pulp. These base papers may contain additives usually employed in paper manufacture such as sizing agents, binders, fixing agents, yield-improving agents, cationated agents, paper stiffness enhancing agents, reinforcing agents, fillers, anti-static agents, fluorescent brightening agents or dyes. A surface sizing agent, a surface reinforcing agent, a fluorescent brightening agent, an antistatic agent and an anchoring agent may be coated on the surface of the material.

The thickness of the base paper is not specifically limited, but preferably ranges from 10 to 200 $\mu$m. A base paper having a smooth surface is preferred; it is obtained by applying a pressure to or calendering the paper, during or after papering. The weight of the base paper is preferably from 30 to 250 g/m$^2$. The resin used in the manufacturing of resin-covered paper is preferably a polyolefin resin or a resin capable of being hardened with an electron beam. The polyolefin resin includes an olefin homopolymer such as a low density polyethylene, a high density polyethylene, polypropylene or polypentene, an olefin copolymer such as ethylene-propylene copolymer or mixtures thereof, each having various densities or melt viscosity indexes (melt index). These resins can be used singly or in combination.

The resin used to prepare the resin-covered paper preferably contains various additives, for example, white pigments such as titanium oxide, zinc oxide, talc or calcium carbonate, a fatty acid amide such as stearic acid amide or arachidic acid amide, a fatty acid metal salt such as zinc stearate, calcium stearate, aluminum stearate or magnesium stearate, an anti-oxidant such as Irganox™ 1010 or Irgano™ 1076, blue pigments or dyes such as cobalt blue, ultramarine, or phthalocyanide blue, magenta pigments or dyes such as cobalt violet, fast violet or manganese violet, a brightening agent and a UV absorber. These additives can be suitably used in combination.

The resin-covered paper, which is the support preferably used in the present invention, is manufactured by the so-called extrusion method, casting a thermally fused resin (for example, fused polyolefin) on the moving paper, whereby both surfaces of the paper are covered with the resin. When the paper is covered with a resin capable of being hardened with electron beam irradiation, the resin is coated with a conventional coater such as a gravure coater or a blade coater and then is irradiated with an electron beam to harden the coated resin. Before the paper is coated with a resin, the surface of the paper is preferably subjected to activation treatments such as a corona discharge or flame treatment. The surface of the support on the ink receiving layer side is glossy or matted depending upon its usage, but glossy surface is, preferable. The back side of the support is not necessarily covered with resin, but this is preferably done to prevent curling. The back surface of a support is ordinarily non-glossy, but this one or both surfaces of the support are optionally subjected to activation treatments, such as a corona discharge or flame treatment. The thickness of a covered resin is not specifically limited, but is ordinarily from 5 to 50 $\mu$m.

A subbing or primer layer may be provided to improve the adhesion between the film support and the ink receiving layer(s). Useful subbing layers for this purpose are widely known in the photographic art and include, for example, polymers of vinylidene chloride such as vinylidene chloride/acrylonitrile/acrylic acid or vinylidene chloride/methyl acrylate/itaconic acid terpolymers, gelatin, gelatin derivatives, caseine, caseine derivatives.

In addition to the above mentioned ingredients, the ink receiving layer(s) can comprise several adjuvants dispersed therein. Useful adjuvants are represented by fillers, surfactants, mordants, matting agents, hardeners, plasticizers, and the like.

Organic and inorganic particles can be used as fillers. Useful examples of fillers are represented by silica (colloidal silica), alumina or alumina hydrate (aluminazol, colloidal alumina, a cation aluminum oxide or its hydrate and pseudo-boehmite), a surface-processed cation colloidal silica, aluminum silicate, magnesium silicate, magnesium carbonate, titanium dioxide, zinc oxide, calcium carbonate, kaoline, talc, clay, zinc carbonate, satin white, diatomaceous earth, synthetic amorphous silica, aluminum hydroxide, lithopone, zeolite, magnesium hydroxide and synthetic mica. Among these inorganic pigments, porous inorganic pigments are preferable, such as porous synthetic silica, porous calcium carbonate and porous alumina.

Useful examples of organic fillers are represented by polystyrene, polymethacrylate, polymethylmethacrylate, elastomers, ethylenevinyl-acetate copolymers, polyesters, polyester copolymers, polyacrylates, polyvinylethers, polyamides, polyolefines, polysilicones, guanamine resins, polytetrafluoroethylene, elastomeric styrene-butadiene rubber (SBR), urea resins, urea-formalin resins. Such organic fillers may by used in combination, and/or in place of the above-mentioned inorganic fillers.

The above mentioned fillers are added to the ink receiving layer(s) in an amount of from 0.1 to 5 g/m$^2$, preferably from 0.2 to 3 g/m$^2$, most preferably from 0.3 to 1 g/m$^2$.

Preferred examples of the surfactants include anionic surfactants, amphoteric surfactants, cationic surfactants, and nonionic surfactants.

Examples of the anionic surfactants include alkylsulfocarboxylates, olefin sulfonates, polyoxyethylene alkyl ether acetates, N-acyl amino acid and salts thereof, N-acyl methyltaurine salts, alkylsulfate, polyoxy alkyl ether sulfates, polyoxyethylene alkyl ether phosphates, rosin soap, castor oil sulfate, lauryl alcohol sulfate, alkylphenol phosphates, alkyl phosphates, alkyl allyl sulfonates, diethylsulfosuccinate, diethylhexylsulfosuccinate, and dioctylsulfosuccinate.

Examples of the cationic surfactants include 2-vinylpyridine derivatives and poly vinylpyridine derivatives.

Examples of the amphoteric surfactants include lauryl dimethyl aminoacetic acid betaine, 2-alkyl-N-carboxymethyl-N-hydroxyethyl imidazolinium betaine, propyldimethylaminoacetic acid betaine, polyoctyl polyaminoethyl glycine, and imidazoline derivatives.

Examples of non-ionic surfactants include non-ionic fluorinated surfactants and non-ionic hydrocarbon surfactants. Useful examples of non-ionic hydrocarbon surfactants include ethers, such as polyoxyethylene nonyl phenyl ether, polyoxyethylene octyl phenyl ether, polyoxyethylene dodecyl phenyl ether, polyoxyethylene alkyl allyl ethers, polyoxyethylene oleyl ether, polyoxyethylene lauryl ether, polyoxyethylene alkyl ethers, polyoxyalkylene alkyl ethers; esters, such as polyoxyethylene oleate, polyoxyethylene distearate, sorbitan laurate, sorbitan monostearate, sorbitan monooleate, sorbitan sesquioleate, polyoxyethylene monooleate, and polyoxyethylene stearate; and glycol surfactants. Specific examples of nonionic surfactants include octylphenoxy polyethoxy ethanols, such as Triton™ X-100, X-114, and X-405, available from Union Carbide Co., Danbury, Conn.; acetylenic diols such as 2,4,7,9-tetramethyl-5-decyn-4,7-diol and the like, such as Surfynol™ GA and Surfynol™ CT-136, available from Air Products & Chemicals Co., Allentown, Pa., trimethyl nonylpolyethylene-glycol ethers, such as Tergitol™ TMN-10 (containing 10 oxyethylene units, believed to be of the formula $C_{12}H_{25}O(C_2HO)_5H$), available from Union Carbide Co., Danbury, Conn.; non-ionic esters of ethylene oxide, such as Merpol™ SH (believed to be of the formula $CH_3(CH_2)_{12}(OC_2H_6)_8OH$), available from E. I. Du Pont de Nemours & Co., Wilmington, Del.; non-ionic esters of ethylene oxide and propylene oxide, such as Merpol™ LFH (believed to be of the formula $CH_3(CH_2)_n(OC_2H_4)_3(OC_3H_6)_8OH$, where n is an integer from about 12 to about 16), available from E. I. Du Pont de Nemours & Co., Wilmington, Del., and the like, as well as mixtures thereof. Non-limiting examples of non-ionic fluorinated surfactants include linear perfluorinated polyethoxylated alcohols (e.g., Zonyl™ FSN, Zonyyl™ FSN-100, Zonyl™ FSO, and Zonyl™ FSO-100 available from DuPont Specialty Chemicals, Wilmington, Del.), fluorinated alkyl polyoxyethylene ethanols (e.g., Fluorad™ FC-170C available from 3M, St. Paul, Minn.), fluorinated alkyl alkoxylate (e.g., Fluorad™ FC-171 available from 3M, St. Paul, Minn.), fluorinated alkyl esters (e.g., Fluorad™ FC-430, FC431, and FC-740 available from 3M, St. Paul, Minn.) and fluorine-substituted alkyl esters and perfluoroalkyl carboxylates (for example, F-tergent series manufactured by Neos Co., Ltd., Lodyne series manufactured by Ciba-Geigy, Monflor series manufactured by ICI, Surfluon series manufactured by Asahi Glass Co., Ltd., and Unidyne series manufactured by Daikin Industries, Ltd.). Preferred nonionic fluorocarbon surfactants include Zonyl™ FSO, Fluorad™ FC-170C, and Fluorad™ FC-171.

The above mentioned surfactants are added to the ink receiving layers in an amount of from 0.01 to 1.0 g/m$^2$, preferably from 0.05 to 0.50 g/m$^2$.

Mordants may be incorporated in the ink-receptive layer of the present invention. Such mordants are represented by cationic, compounds, monomeric or polymeric, capable of complexing with the dyes used in the ink compositions. Useful examples of such mordants include quaternary ammonium block copolymers, such as Mirapol A-15 and MirapoL WT available from Miranol Incorporated, Dayton, N.J., prepared as disclosed in U.S. Pat. No. 4,157,388, Mirapol AZ-I available from Miranol Inc., prepared as disclosed in U.S. Pat. No. 4,719,282, Mirapol AD-I available from Miranol Inc., prepared as disclosed in U.S. Pat. No. 4,157,388, Mirapol 9, Mirapol 95, and Mirapol 175 available from Mirapol Inc., prepared as disclosed in U.S. Pat. No. 4,719,282, and the like. Other suitable mordants comprise diamino alkanes, ammonium quaternary salts (such as polyvinylbenzyl quaternary ammonium salts disclosed in U.S. Pat. No. 4,794,067), and quaternary acrylic copolymer latexes.

Other suitable mordants are fluoro compounds, such as tetra ammonium fluoride hydrate, 2,2,2-trifluoroethylamine hydrochloride (Aldrich #18,038-6); 2,2,2-trifluoroethyltoluene sulfonate (Aldrich #17,782-2); 1-(α,α,α-trifluoro-m-tolyl) piperazine hydrochloride, 4-bromo-α,α,α-trifluoro-o-toluidine hydrochloride, difluorophenylhydrazine hydrochloride, 4-fluorobenzylamine hydrochloride, 4-fluoro-α,α-dimethylphenethylamine hydrochloride, 2-fluoroethylamine hydrochloride, 2-fluoro-1-methylpyridinium-toluene sulfonate, 4-fluorophenethylamine hydrochloride, fluorophenylhydrazine hydrochloride, 1-(2-fluorophenyl) piperazine monohydrochloride, 1-fluoro pyridinium trifluoromethane sulfonate.

Further mordants are monoammonium compounds as disclosed, for example, in U.S. Pat. No. 5,320,902, including (A) tetradecyl ammonium bromide (Fluka 87582), tetradodecyl ammonium bromide (Fluka 87249), tetrahexadecyl ammonium bromide (Fluka 87298), tetraoctadecyl ammonium bromide (Aldrich 35,873-8), and the like; (B) 2-coco trimethyl ammonium chloride (Arquad C-33, C-33W, C-50 from Akzo Chemie), palmityl trimethyl ammonium chloride (Adogen 444 from Sherex Chemicals), myristyl trimethyl ammonium bromide (Cetrimide BP Triple Crown America), benzyl tetradecyl dimethyl ammonium chloride (Arquad DM 14B-90 from Akzo Chemie), didecyl dimethyl ammonium bromide (Aldrich 29,801-8), dicetyl dimethyl ammonium chloride (Adogen 432CG, Sherex Chemicals), distearyl dimethyl ammonium methyl sulfate (Varisoft 137, 1906100P from Sherex Chemicals, Arosurf TA-100 from Sherex Chemicals), difatty acid isopropyl ester dimethyl ammonium methyl sulfate (Rewoquat CR 3099 from Rewo Quimica, Loraquat CR 3099 from Dutton and Reinisch), tallow dimethyl trimethyl propylene diammonium chloride (Tomah QD-T from Tomah), and Netyl, N-ethyl morpholinium ethosulfate (G263 from ICI Americas).

Additional mordants are phosphonium compounds, such as, for example, those disclosed in U.S. Pat. No. 5,766,809, including bromomethyl triphenyl phosphonium bromide (Aldrich 26,915-8), 3-hydroxy-2-methyl propyl triphenyl phosphonium bromide (Aldrich 32,507-4), 2-tetraphenyl phosphonium bromide (Aldrich 21,878-2), tetraphenyl phosphonium chloride (Aldrich 21879, hexadecyl tributyl phosphonium bromide (Aldrich 27,620U), and stearyl tributyl phosphonium bromide (Aldrich 29,303-2).

Additional examples of mordants include those disclosed in U.S. Pat. Nos. 5,760,809; 5,457,486; 5,314,747; 5,320,902 and 5,441,795. The ink receiving layer can be hardened with a hardener to improve water resistance or dot reproduction. Examples of hardeners include aldehyde compounds such as formaldehyde and glutaraldehyde, ketone compounds such as diacetyl and chloropentanedion, bis(2-chloroethylurea), 2-hydroxy4,6-dichloro-1,3,5-triazine, reactive halogen-containing compounds disclosed U.S. Pat. No. 3,288,775, carbamoyl pyridinium compounds in which the pyridine ring carries a sulfate or alkylsulfate group disclosed in U.S. Pat. Nos. 4,063,952 and 5,529,892, divinylsulfones, reactive olefin-containing compounds disclosed U.S. Pat. No. 3,635,718, N-methylol-derived compounds disclosed in U.S. Pat. No. 2,732,316, isocyanates disclosed in U.S. Pat. No. 3,103,437, aziridine-derived compounds disclosed in U.S. Pat. Nos. 3,017,280 and 2,983,611, carbodiimides is disclosed in U.S. Pat. No. 3,100,704, epoxy compounds disclosed in U.S. Pat. No. 3,091,537, halogen-carboxyaldehydes such as mucochloric acid, dioxane derivatives such as dihydroxy dioxane, and inorganic hardeners such as chromium alum, potash alum and zirconium sulfate. These hardeners can be used singly or in combination. The addition amount of hardener is preferably 0.01 to 10 g, and more preferably 0.1 to 5 g based on 100 g of the binder contained in the ink receiving layer.

The ink receiving layer may contain a matting agent in an amount of 0.005 to 0.1 g/m$^2$ to prevent adhesion defects such as blocking. The matting agent can be defined as particles of inorganic or organic materials capable of being discontinuously dispersed in a hydrophilic organic colloid. The inorganic matting agents include oxides such as silicon oxide, titanium oxide, magnesium oxide and aluminum oxide, alkali earth metal salts such as barium sulfate, calcium carbonate, and magnesium sulfate, light-insensitive silver halide particles such as silver chloride and silver bromide (each of which may contain a small amount of iodine), and glass particles. Besides these substances there may be used inorganic matting agents disclosed in DE Patent 2,529,321, in GB Patents 760,775 and 1,260,772, in U.S. Pat. Nos. 1,201,905, 2,192,241, 3,053,662, 3,062,649, 3,257,296, 3,322.555, 3,353,958, 3,370,951, 3,411,907.3, 437,484, 3.523,022, 3,615,554, 3,635,714, 3,769,020, 4,021,245 and 4,029,504. The organic matting agents include starch, cellulose esters such as cellulose acetate propionate, cellulose ethers such as ethyl cellulose, and synthetic resins. The synthetic resins are water insoluble or sparingly soluble polymers which include a polymer of an alkyl(meth) acrylate, an alkoxyalkyl-(meth)acrylate, a glycidyl(meth) acrylate, a (meth)acrylamide, a vinyl ester such as vinyl acetate and acrylonitrile, an olefin such as ethylene, or styrene and a copolymer of the above described monomers with other monomers such as acrylic acid, methacrylic acid, α,β-unsaturated dicarboxylic acid, hydroxyalkyl(meth) acrylate, sulfoalkyl(meth)acrylate and styrene sulfonic acid. Further, a benzoguanamin-formaldehyde resin, an epoxy resin, nylon, polycarbonates, phenol resins, polyvinyl carbazol or polyvinylidene chloride can be used. Besides the above compounds, there are used organic matting agents disclosed in GB Patent 1,055,713, in U.S. Pat. Nos. 1,939,213, 2,221,873, 2,268,662, 2,322,037, 2,376,005, 2,391,181, 2,701,245, 2,992,101, 3,079,257, 3,262,782, 3,443,946, 3.516,832, 3,539,344,554, 3,591,379, 3,754,924 and 3,767,448, in JP Patents 49-106821/1974 and 57-1483511982. These matting agents may be used alone or in combination.

The ink-receiving layer of the present invention can also comprise a plasticizer such as ethylene glycol, diethylene glycol, propylene glycol, polyethylene glycol, glycerol monomethylether, glycerol monochlorohydrin, ethylene carbonate, propylene carbonate, tetrachlorophthalic anhydride, tetrabromophthalic anhydride, urea phosphate, triphenylphosphate, glycerol monostearate, propylene glycol monostearate, tetramethylene sulfone, N-methyl-2-pyrrolidone, N-vinyl-2-pyrrolidone, and polymer latices with a low Tg-value such as polyethylacrylate, polymethylacrylate, etc.

The ink receiving layer can comprise biocides. Examples of suitable biocides include (A) nonionic biocides, such as 2-bromo-4'-hydroxyacetophenone (Busan 90 available from Buckman Laboratories); 3,5-dimethyl tetrahydro-2H-1,3,5-thiadiazine-2-thione (Slime-Trol RX-28 available from Betz Paper Chem Inc.); a nonionic blend of 5-chloro-2-methyl-4-isothiazoline-3-one, 75% by weight, and 2-methyl4-isothiazolin-3-one, 25% by weight (available as Amerstat 250 from Drew Industrial Division; Nalcon 7647 from Nalco Chemical Company; Kathhon Lx from Rohm and Haas Company); and the like, as well as mixtures thereof; (B) anionic biocides, such as anionic potassium N-hydroxymethyl-N-methyl-dithiocarbamate (available as Busan 40 from Buckman Laboratories Inc.); an anionic blend of methylene bis-thiocyanate, 33% by weight, sodium dimethyl-dithiocarbamate, 33% by weight, and sodium ethylene bisdithiocarbamate, 33% by weight, (available as Amerstat 282 from Drew Industrial Division; AMA-131 from Vinings Chemical Company); sodium dichlorophene (G-4-40 available from Givaudan Corporation); and the like, as well as mixtures thereof; (C) cationic biocides, such as poly(oxyethylene (dimethylamino)ethylene (dimethylamino) ethylene dichloride) (Busan 77 available from Buckman Laboratories all Inc.); a cationic blend of bis(trichloromethyl) sulfone and quaternary ammonium chloride (available as Slime-Trol RX-36 DPB865 from Betz Paper Chem. Inc.); and the like, as well as mixtures thereof. The biocide can be present in any effective amount; typically, the biocide is present in an amount of from 0.1 to 3% by weight of the coating composition, although the amount can be outside this range.

The ink receiving layer of the invention may further contain various conventional additives such as colorants, colored pigments, pigment dispersants, lubricants, permeating agents, fixing agents for ink dyes, UV absorbers, antioxidants, dispersing agents, anti-foaming agents, leveling agents, fluidity improving agents, antiseptic agents, brightening agents, viscosity stabilizing and/or enhancing agents, pH adjusting agents, anti-mildew agents, anti-fungal agents, moisture-proofing agents, paper stiffness increasing agents and anti-static agents.

The above-mentioned various additives can be added ordinarily in a range of 0 to 10% by weight of the solid content of the ink receiving layer composition.

As a coating method of an ink receiving layer coating solution, any conventional coating method (for example, a curtain method, an extrusion method, an air-knife method, a slide coating, a roll coating method, reverse roll coating, solvent extrusion, dip coating processes and a rod bar coating method) can be used.

The ink-receiving layer of the present invention is preferably coated on one side of the support as a plurality of at least two distinct layers, coated from different coating solutions. Most preferably, the ink-receiving layer of the present invention is coated on one side of the support as a plurality of three distinct layers, coated from different coating solutions. When preparing an ink-jet receiving sheet according to this invention, by coating two or more ink-receiving layers onto a support, it is possible to prepare an ink-receiving sheet with excellent properties, especially with respect to glossiness and post printed drop sweating after stressed ageing.

The ink jet receiving sheet of the invention has a surface pH value lower than 5.0, preferably in the range from 3.5 to 4.5. At surface pH values lower than 5 good glossiness, defined as the quantity of reflected light measured at a predetermined angle (generally at 20°, 60° or 85°) with respect to the direction of the incident light and expressed in percentage, can be noted.

Specific embodiments of the invention will now be described in detail. The following examples are intended to be illustrative, and the invention is not limited to the materials, conditions, or process parameters set forth in these embodiments. All parts and percentages are by weight unless otherwise indicated.

EXAMPLES

Example 1

Sample 1 (Reference).

A receiving ink jet sheet was prepared using a support comprising a paper base having a weight of 170 g/m on which a resin portion having a weight of 25 g/m$^2$ of low density polyethylene was coated on both sides. A gelatin primer was coated on the front side and an anticurl gelatin layer was coated on the back side.

Three coating solutions were prepared using the components indicated below dissolved in water. The solutions were adjusted to pH 4.0 using sulfuric acid before coating them all at once with extrusion system at 10.6 meter by minute on the front side of the aforementioned support.

The resulting coating was dried to give a multilayer inkjet receiving sheet with the following composition:

First layer: 2.89 g/m$^2$ of gelatin; 0.47 g/m$^2$ of Glucidex-19, a polysaccharide available from Roquette, and 0.06 g/m$^2$ of Triton X 100;

Second layer: 2.74 g/m of gelatin, 1.58 g/m$^2$ of PVP-K 90, 0.44 g/m$^2$ of Glucidex-19, 0.06 g/m$^2$ of Triton X 100, and 0.08 g/m$^2$ of fine particles of aluminum oxide;

Third layer: 0.47 g/m$^2$ of gelatin, 0.23 g/m$^2$ of PVP-K 90, 0.08 g/m$^2$ of Glucidex-19, 0.07 g/m$^2$ of Zonyl FSN 100, 0.06 g/m$^2$ of P.M.M.A, and 0.04 g/m$^2$ of cross-linking agent H-1.

Sample 2 (Invention).

The procedure of sample 1 was repeated with the same ingredients, except that 0.075 g/m$^2$ of $Ca(NO_3)_2.4H_2O$ (corresponding to 0.32 millimole/m$^2$ of Calcium$^{++}$) were added both to the first and second layer.

Sample 3 (Invention).

The procedure of sample 1 was repeated with the same ingredients, except that 0.150 g/m$^2$ of $Ca(NO_3)2.4H_2O$ (corresponding to 0.64 millimole/m$^2$ of Calcium$^{++}$) were added both to the first and second layer.

Sample 4 (Invention).

The procedure of sample 1 was repeated with the same ingredients, except that 0.300 g/m$^2$ of $Ca(NO_3)_2.4H_2O$ (corresponding to 1.28 millimole/m$^2$ of Calcium$^{++}$) were added both to the first and second layer.

Sample 5 (Reference).

The procedure of sample 1 was repeated with the same ingredients, except that nitric acid rather than sulfuric acid was used to adjust the coating solutions to pH 4.0.

Sample 6 (Invention).

The procedure of sample 5 was repeated with the same ingredients, except that 0.150 g/m$^2$ of $Ca(NO_3)_2.4H_2O$ (corresponding to 0.64 millimole/m$^2$ of Calcium$^{++}$) were added to both the first and second layer.

Sample 7 (invention).

The procedure of sample 5 was repeated with the same ingredients, except that 0.300 g/m$^2$ of $Ca(NO_3)_2.4H_2O$ (corresponding to 1.28 millimole/m$^2$ of Calcium$^{++}$) were added to both the first and second layer.

Sample 8 (invention).

The procedure of sample 5 was repeated with the same ingredients, except that 0.162 g/m$^2$ of $MgSO_4.7H_2O$ (corresponding to 0.66 millimole/m$^2$ of Magnesium$^{++}$) A were added to both the first and second layer.

Sample 9 (Invention).

The procedure of sample 5 was repeated with the same ingredients, except that 0.187 g/m$^2$ of $ZnSO_4.7H_2O$ (corresponding to 0.65 millimole/m$^2$ of Zinc$^{++}$) were added to both the first and second layer.

Sample 10 (Invention).

The procedure of sample 5 was repeated with the same ingredients, except that 0.159 g/m$^2$ of $BaCl_2.2H_2O$ (corresponding to 0.65 millimole/m$^2$ of Barium$^{++}$) were added to both the first and second layer.

Sample 11 (Comparison).

The procedure of sample 5 was repeated with the same ingredients, except that 0.162 g/m$^2$ of $La(NO_3)_3.4H_2O$ (corresponding to 0.65 millimole/m$^2$ of Lanthanum$^{+++}$) were added to both the first and second layer.

Sample 12 (Comparison).

The procedure of sample 7 was repeated with the same ingredients, except that the solution was adjusted to pH 5.0 using nitric acid.

Sample 13 (Comparison).

The procedure of sample 7 was repeated with the same ingredients, except that 01 the solution was adjusted to pH 5.5 using nitric acid.

An evaluation image pattern was printed on samples 1 to 13 using a Stylus Photo 700 color ink jet printer (produced by Epson). The black density was generated using a dye and the ink was uniformly jetted at maximum ink jetting amount possibility of the printer. The obtained printed samples were submitted to sweating evaluation, measured both on fresh samples and to samples submitted to accelerated ageing, at 22° C. and 75% relative humidity for two hours. The printed surface was inspected to detect the presence of organic drop sweating. For each evaluation, a ranking score was given from 1 to 10, wherein 10 means "Surface completely free of sweating drops" and 1 means "Very high level of sweating drops observed". The glossiness was measured on unprinted samples at an angle of 60° with a TR1-Microgloss-160 (Produced by Sheen) as disclosed in ASTM standard No. 523. The results are shown in Table 1.

As we can see from table 1, Samples 2 to 4 and Samples 6 to 10 of the present invention, containing salts of metal selected from the IIA or IIB groups of the periodic table of elements, show a significant reduction of the problem of post printed drop sweating after stressed ageing, while reference Samples 1 and 5, not containing said metallic salts, show bad values after aging.

Comparison Sample 11, containing Lanthanum$^{+++}$ salt, exhibits bad sweating values. Comparison Samples 12 and 13, being equal to sample 7 but with higher values of surface pH (5.0 and 5.5, respectively), exhibit bad glossiness values.

Triton™ X-100 is the trade name of a non-ionic surfactant of the alkylphenoxyethylene type having a dynamic surface tension of 32 dyne/cm$^2$, a HLB value of 13.5 and corresponding to the following formula:

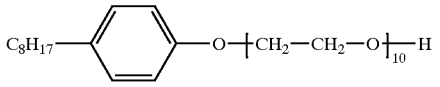

Zonyl™ FSN 100 is the trade name of a non-ionic surfactant of the perfluoro alkylpolyoxyethylene type, manufactured by DuPont having a dynamic surface tension of 26 dyne/cm$^2$, a HLB value in the range 10–13 and corresponding to the following formula:

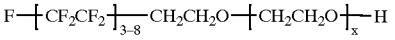

Hardening agent H-1 is a pyridinium derivative having the following formula:

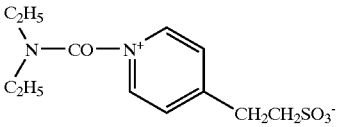

Glucidex-19' is the trade names of a polysaccharide available from Roquette Freres S. A., Lilie, France.

PVP-K 90 is a polyvinylpyrrolidone available from Fluka.

What is claimed is:

1. An ink jet receiving sheet comprising a support and at least an ink receiving layer containing a binder selected from the group consisting of gelatin and gelatin derivatives, characterized in that said receiving layer comprises at least a salt of a metal selected from the IIA or IIB groups of the

TABLE 1

| | | mg/m$^2$ | | millimol/m$^2$ | | | | | Sweating | |
|---|---|---|---|---|---|---|---|---|---|---|
| Samples | Compound | I Layer | II Layer | I Layer | II Layer | Acid | pH | Glossiness | On Fresh | After Ageing |
| 1 (Ref.) | — | — | — | — | — | $H_2SO_4$ | 4.0 | 80 | 10 | 5 |
| 2 (Inv.) | $Ca(NO_3)_2.4H_2O$ | 75 | 75 | 0.32 | 0.32 | $H_2SO_4$ | 4.0 | 87 | 10 | 8 |
| 3 (Inv.) | $Ca(NO_3)_2.4H_2O$ | 150 | 150 | 0.64 | 0.64 | $H_2SO_4$ | 4.0 | 87 | 10 | 8 |
| 4 (Inv.) | $Ca(NO_3)_2.4H_2O$ | 300 | 300 | 1.28 | 1.28 | $H_2SO_4$ | 4.0 | 88 | 10 | 9 |
| 5 (Ref.) | — | — | — | — | — | $HNO_3$ | 4.0 | 80 | 10 | 5 |
| 6 (Inv.) | $Ca(NO_3)_2.4H_2O$ | 150 | 150 | 0.64 | 0.64 | $HNO_3$ | 4.0 | 88 | 10 | 9 |
| 7 (Inv.) | $Ca(NO_3)_2.4H_2O$ | 300 | 300 | 1.28 | 1.28 | $HNO_3$ | 4.0 | 90 | 10 | 10 |
| 8 (Inv.) | $MgSO_4.7H_2O$ | 162 | 162 | 0.65 | 0.65 | $HNO_3$ | 4.0 | 83 | 10 | 10 |
| 9 (Inv.) | $ZnSO_4.7H_2O$ | 187 | 187 | 0.65 | 0.65 | $HNO_3$ | 4.0 | 82 | 10 | 9 |
| 10 (Inv.) | $BaCl_2.2H_2O$ | 159 | 159 | 0.65 | 0.65 | $HNO_3$ | 4.0 | 85 | 10 | 9 |
| 11 (Comp.) | $La(NO_3)_3.4H_2O$ | 258 | 258 | 0.65 | 0.65 | $HNO_3$ | 4.0 | 80 | 8 | 2 |
| 12 (Comp.) | $Ca(NO_3)_2.4H_2O$ | 300 | 300 | 1.28 | 1.28 | $HNO_3$ | 5.0 | 50 | 10 | 10 |
| 13 (Comp.) | $Ca(NO_3)_2.4H_2O$ | 300 | 300 | 1.28 | 1.28 | $HNO_3$ | 5.5 | 15 | 10 | 10 |

periodic table of elements or complexes which comprise said metal salts and in that said receiving sheet has a surface pH value lower than 5.0.

2. The ink jet receiving sheet according to claim 1, characterized in that said receiving layers totally comprise a gelatin amount ranging from 1 to 20 $g/m^2$.

3. The ink jet receiving sheet according to claim 1, characterized in that said metal is selected from the group consisting of calcium, magnesium, zinc and barium.

4. The ink jet receiving sheet according to claim 1, characterized in that said metal salt is an inorganic salt.

5. The ink jet receiving sheet according to claim 1, characterized in that said metal salt is selected from the group consisting of magnesium sulfate, magnesium nitrate, calcium sulfate, calcium nitrate, zinc sulfate, zinc nitrate and barium chloride.

6. The ink jet receiving sheet according to claim 1, characterized in that said receiving layers totally comprise an amount of said metal salt in the range from 0.05 to 2.0 $g/m^2$.

7. The ink jet receiving sheet according to claim 1, characterized in that said receiving layers totally comprise a ratio of gelatin to metal salt in the range from 2:1 to 200:1.

8. The ink jet receiving sheet according to claim 1, characterized in that said receiving layers comprise at least one saccharide selected from the group consisting of monosaccharides, oligosaccharides, and polysaccharides.

9. The ink jet receiving sheet according to claim 1, characterized in that said receiving sheet comprises at least two adjacent ink receiving layers coated on the same side of the support, and in that both adjacent ink receiving layers nearest to the support each comprise a metal salt amount ranging from 0.025 to 1 $g/m^2$.

10. An ink jet receiving sheet comprising a support and at least one ink receiving layer containing a binder selected from the group consisting of gelatin and gelatin derivatives, characterized in that said receiving layer comprises at least a nitrate or sulfate salt of a metal selected from the IIA or IIB groups of the periodic table of elements or complexes which comprise said metal salts and in that said receiving sheet has a surface pH value lower than 5.0.

11. The ink jet receiving sheet according to claim 10, characterized in that said metal is selected from the group consisting of calcium, magnesium, zinc and barium.

12. An ink jet receiving sheet comprising a support and at least one ink receiving layer containing a binder comprising gelatin or gelatin derivatives, characterized in that said receiving layer comprises at least a salt of a metal selected from the group consisting of calcium, magnesium, zinc and barium or complexes which comprise said metal salts and said receiving sheet has a surface pH value lower than 5.0.

13. The ink jet receiving sheet according to claim 12, characterized in that said receiving layers totally comprise a gelatin amount ranging from 1 to 20 $g/m^2$.

14. The ink jet receiving sheet according to claim 12, characterized in that said metal salt has an anion selected from the group consisting of sulfate and nitrate.

15. The ink jet receiving sheet according to claim 13, characterized in that said metal salt has an anion selected from the group consisting of sulfate and nitrate.

16. The ink jet receiving layer of claim 12 wherein the metal salt comprises calcium nitrate.

17. The ink jet receiving layer of claim 12 wherein the metal salt comprises magnesium sulfate.

18. The ink jet receiving layer of claim 12 wherein the metal salt comprises zinc sulfate.

19. The ink jet receiving layer of claim 12 wherein the metal salt comprises barium chloride.

* * * * *